US007878104B2

(12) United States Patent
Floch

(10) Patent No.: US 7,878,104 B2
(45) Date of Patent: Feb. 1, 2011

(54) ARMORED SHELL KIT AND ASSOCIATED METHOD OF ARMORING A VEHICLE

(75) Inventor: Ronan Floch, Planguenoual (FR)

(73) Assignee: Armor Holdings, Inc., Jacksonville, FL (US)

( * ) Notice: Subject to any disclaimer, the term of this patent is extended or adjusted under 35 U.S.C. 154(b) by 905 days.

(21) Appl. No.: 11/536,968

(22) Filed: Sep. 29, 2006

(65) Prior Publication Data

US 2010/0251884 A1 Oct. 7, 2010

Related U.S. Application Data

(60) Provisional application No. 60/722,546, filed on Sep. 30, 2005.

(51) Int. Cl.
*F41H 5/14* (2006.01)

(52) U.S. Cl. ..... 89/36.09; 89/36.08; 296/187.07

(58) Field of Classification Search ..... 89/36.07–36.09, 89/36.11–36.13; 296/187.07
See application file for complete search history.

(56) References Cited

U.S. PATENT DOCUMENTS

| | | | | |
|---|---|---|---|---|
| 787,065 | A | 4/1905 | White | |
| 796,768 | A | 8/1905 | Steinmetz | |
| 2,348,130 | A | 5/1944 | Hardy, Jr. | |
| 2,363,573 | A * | 11/1944 | Costa | 89/36.8 |
| 2,382,862 | A * | 8/1945 | Davis, Jr. | 89/36.8 |
| 2,389,579 | A | 11/1945 | Reynolds | |
| 2,399,691 | A | 5/1946 | Partiot | |
| 2,758,660 | A | 8/1956 | Bouffort | |
| 3,575,786 | A | 4/1971 | Baker et al. | |
| 3,699,842 | A | 10/1972 | Grewing et al. | |
| 3,765,299 | A | 10/1973 | Pagano et al. | |
| 4,061,815 | A | 12/1977 | Poole, Jr. | |
| 4,111,097 | A | 9/1978 | Lasker | |
| 4,131,053 | A | 12/1978 | Ferguson | |
| 4,186,648 | A | 2/1980 | Clausen et al. | |
| 4,198,454 | A | 4/1980 | Norton | |
| 4,323,000 | A | 4/1982 | Dennis et al. | |
| 4,326,445 | A * | 4/1982 | Bemiss | 89/36.8 |
| 4,398,446 | A | 8/1983 | Pagano et al. | |
| 4,404,889 | A | 9/1983 | Miguel | |
| 4,529,640 | A | 7/1985 | Brown et al. | |
| 4,566,237 | A | 1/1986 | Turner | |
| 4,716,810 | A | 1/1988 | De Guvera | |
| 4,727,789 | A | 3/1988 | Katsanis et al. | |
| 4,841,838 | A | 6/1989 | Scully et al. | |
| 4,965,138 | A | 10/1990 | Gonzalez | |

(Continued)

FOREIGN PATENT DOCUMENTS

| | | |
|---|---|---|
| DE | 3627 485 A1 | 2/1988 |

(Continued)

*Primary Examiner*—Michael Carone
*Assistant Examiner*—Gabriel J Klein
(74) *Attorney, Agent, or Firm*—Wood, Herron & Evans, LLP

(57) ABSTRACT

A kit for fitting a vehicle with protective armor includes an armored floor panel configured to be installed to a frame of the vehicle below an occupant compartment of the vehicle, and an armored shell configured to be received over an outer body of a cab of the vehicle. The armored shell may be removed to return the vehicle to its original, non-armored condition.

14 Claims, 4 Drawing Sheets

U.S. PATENT DOCUMENTS

| | | | | |
|---|---|---|---|---|
| 5,059,467 | A | 10/1991 | Berkovitz | |
| 5,179,244 | A | 1/1993 | Zufle | |
| 5,314,230 | A | 5/1994 | Hutchison et al. | |
| 5,435,226 | A | 7/1995 | McQuilkin | |
| 5,448,938 | A | 9/1995 | Fernandez et al. | |
| 5,474,352 | A * | 12/1995 | Davies | 296/24.3 |
| 5,533,781 | A | 7/1996 | Williams | |
| 5,663,520 | A | 9/1997 | Ladika et al. | |
| 6,216,579 | B1 | 4/2001 | Boos et al. | |
| 7,393,045 | B1 * | 7/2008 | Gonzalez | 296/190.4 |
| 2006/0288856 | A1 * | 12/2006 | Labock | 89/36.4 |

FOREIGN PATENT DOCUMENTS

| | | | |
|---|---|---|---|
| FR | 2706997 | A1 | 12/1994 |
| GB | 2071829 | A * | 9/1981 |
| JP | 4-413669 | A | 5/1992 |
| WO | WO 2004053421 | A1 * | 6/2004 |
| WO | WO 2006085926 | A2 * | 8/2006 |
| WO | WO 2009034372 | A1 * | 3/2009 |

* cited by examiner

ARMORED SHELL KIT AND ASSOCIATED METHOD OF ARMORING A VEHICLE

CROSS-REFERENCE TO RELATED APPLICATIONS

This application claims the benefit of U.S. Provisional Patent Application No. 60/722,546, filed Sep. 30, 2005 by Ronan Floch entitled "Armoured Helmet Kit," which application is incorporated by reference herein.

FIELD OF THE INVENTION

The present invention relates generally to armored vehicles, and more particularly, to an armored shell kit and method for providing armored protection around the cab of a vehicle.

BACKGROUND OF THE INVENTION

Armored vehicles have long been used by both civilians and military personnel to protect occupants from bullets, shells, shrapnel, and other projectiles. For example, politicians, ambassadors, and other civilians who feel at risk to an attack often travel in armored cars. The cars are typically conventional vehicles that have been carefully fitted with armor without changing their outer appearance. As such, the cars usually include bulletproof glass and layers of armored material under the outer body of the vehicle. The process of adding this armored material to a conventional vehicle can be very labor-intensive and take a significant amount of time. Therefore, the process is not particularly suited for military operations and other situations where conventional vehicles may need to be converted into armored vehicles much faster.

Current techniques for quickly modifying a conventional vehicle into an armored vehicle typically involve mounting armored panels or plates to the body of the vehicle. For example, trucks used by the military are often converted into armored vehicles by mounting the plates directly to the exterior of the vehicle. Typically this requires removing all of the windows from the vehicle and replacing them with bulletproof glass. Holes are then drilled into the cab of the vehicle and elsewhere on the body so that fasteners may be used to secure the armored plates.

While armoring a vehicle in such a manner may provide additional protection, there are several challenges associated with doing so. First, the armored panels are relatively heavy, and therefore, significantly increase the weight of the vehicle. Because the original body is not designed to support the additional weight, measures must be taken to ensure that the body does not easily deform upon impact. Typically this involves coupling the armored plates to each other and arranging them to define a support structure or providing additional reinforcing members. For example, the armor plates may be arranged to define a structure that resists the impact forces associated with the vehicle flipping over or being hit with projectiles. The additional plates needed to create the support structure further increases the weight of the vehicle, which limits the vehicle's overall speed and maneuverability.

The conventional armoring process described above involves significant modifications to the outer body so as to make the vehicle less desirable or practical upon removal of the armored plates. For example, if the armored plates are removed, the holes in the outer body become exposed and decrease the visual appeal of the vehicle. Holes in the cab area may also fail to protect occupants from weather, noise, and other elements. The numerous holes therefore provide an unpleasant riding experience and generally render the original cab ineffective for its intended purpose.

The conventional, piecemeal process is additionally labor intensive and time consuming. Drilling the holes into the body and securing the panels, one at a time, can be a cumbersome task.

As can be appreciated, there is needed an improved apparatus and method for fitting a vehicle with protective armor. The armor should be easily installed on the vehicle and leave much of the original body of the vehicle intact. Such apparatus and method would allow the vehicle to be used upon removal of the armor without significant visual or structural defects.

SUMMARY OF THE INVENTION

In one aspect, the invention is a method of fitting a vehicle with protective armor, the vehicle having a cab including an outer body and an occupant compartment. The method comprises installing an armored floor panel to a frame of the vehicle below the occupant compartment, positioning an armored shell over the outer body of the cab, the armored shell having at least a top section, a rear section, and opposed side sections configured to surround the cab so as to protect the occupant compartment; and securing the armored shell to the outer portion of the armored floor panel.

The method can further comprise removing a windshield from the original cab, the armored shell further including a front section with a bulletproof windshield. The method can further comprise removing at least one door from the outer body of the cab, the armored shell having an armored door to define a portion of one of the opposed side sections, and installing a rear-view mirror to the armored door. The method can further comprise installing at least one bracket to a front portion of the vehicle, the at least one bracket being configured to support armored material, wherein securing the armored shell further comprises securing the armored to the at least one bracket. The method can further comprise removing the armored shell from the cab of the vehicle, and removing the armored floor panel from the vehicle. The method can further comprise installing at least one armored panel to a wheel housing proximate the occupant compartment. The method can further comprise installing a weapon station on the top section of the armored shell.

In another aspect, the invention is a kit for fitting a vehicle with protective armor, the vehicle having a cab including an outer body and occupant compartment. The kit comprises an armored floor panel configured to be installed to a frame of the vehicle below the occupant compartment, an armored shell configured to be received over the outer body of the cab and secured to the armored floor panel, the armored shell having at least a top section, a rear section, and opposed side sections configured to surround the cab so as to protect the occupant compartment.

The top section, the rear section, and the opposed side sections of the armored shell can be welded together. The armored shell can further include a front section with a bulletproof windshield. The kit can further comprise at least one mounting bracket configured to be secured to the vehicle and adapted to support armored material.

In yet another aspect, the invention is a method of fitting a vehicle with protective armor, the vehicle having a cab including an outer body and occupant compartment. The method comprises positioning an armored shell over the outer body of the cab, the armored shell having at least a top section, a rear section, and opposed side sections configured to surround the cab so as to protect the occupant compartment, securing the armored shell to a frame of the vehicle, operating the vehicle with the armored shell installed, removing the armored shell from the vehicle and operating the vehicle after the armored shell has been removed.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION OF A PREFERRED EMBODIMENT OF THE INVENTION

Figure 1:
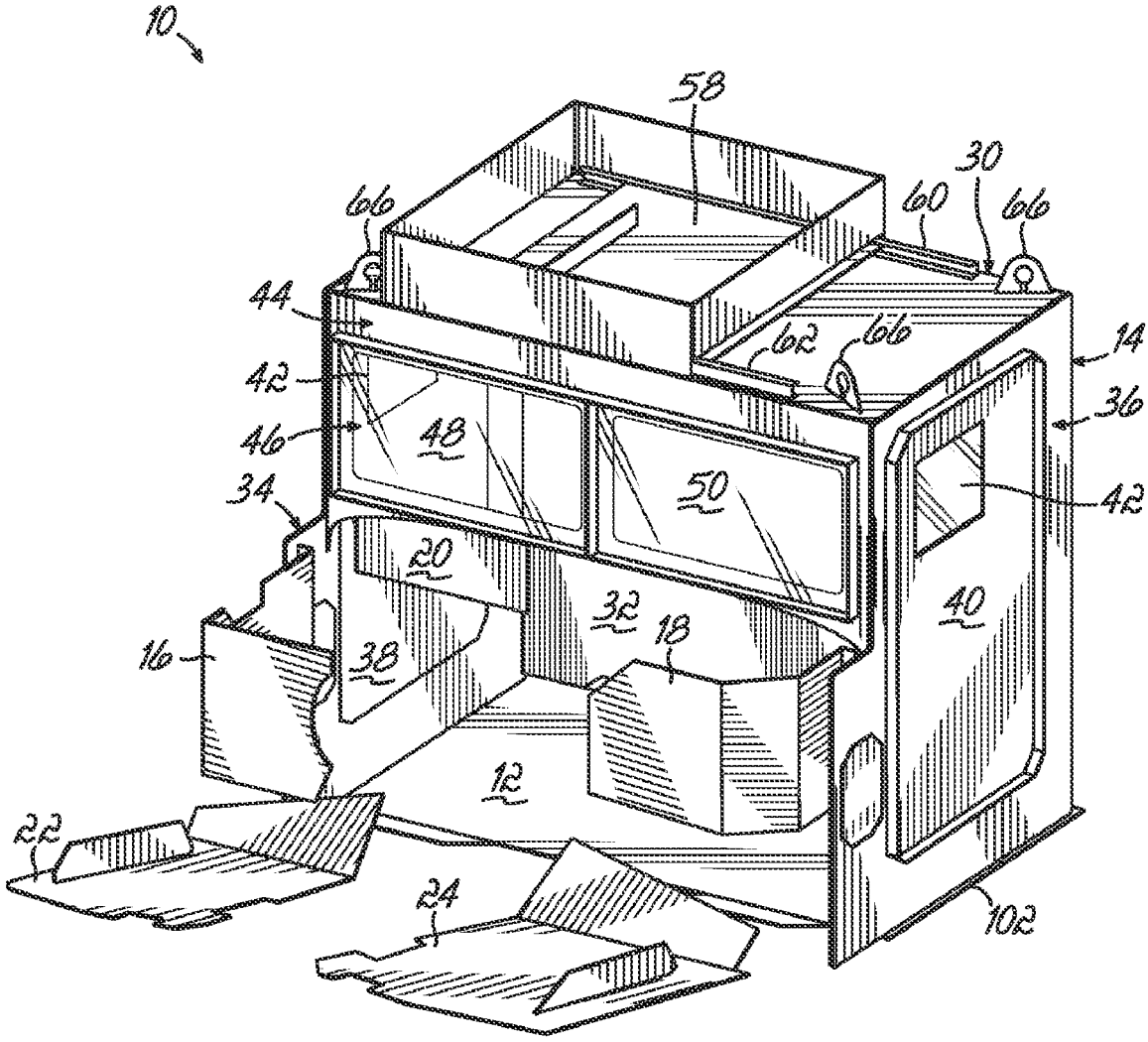
FIG. 1 is an assembled perspective view of the kit according to one embodiment of the invention for fitting a vehicle with protective armor.

With reference to FIG. 1, a kit or assembly 10 for armoring a vehicle is shown in an assembled position. The kit 10 generally comprises an armored floor panel 12 and an armored helmet, or shell 14. The armored shell 14 is configured to be installed over an outer body a vehicle to protect occupants within an occupant compartment, as will be described in greater detail below. Various additional armored components may also be provided with the kit 10 to further protect vehicle occupants and to support the armored shell 14. For example, FIG. 1 illustrates a first support bracket 16, a second support bracket 18, an upper blast panel 20, and lower blast panels 22, 24. The support brackets 16, 18 and upper blast panel 20 are configured to be secured to both the shell 14 and a vehicle, while the lower blast panels 22, 24 are configured to be secured merely to the vehicle. This aspect of the kit 10 will be described in greater detail below as well.

Figure 2:
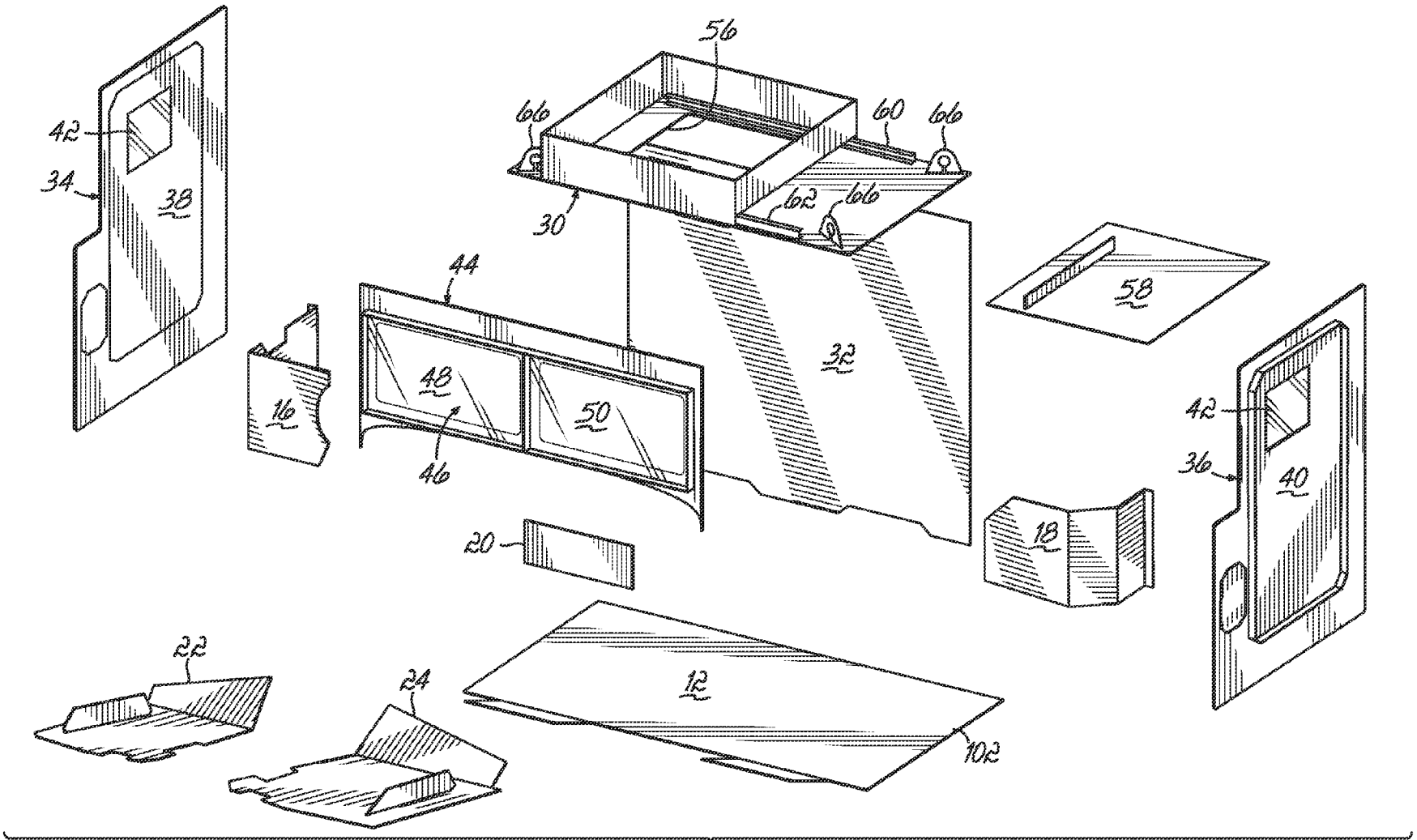
FIG. 2 is a disassembled perspective view of the kit shown in FIG. 1.
Figure 3:
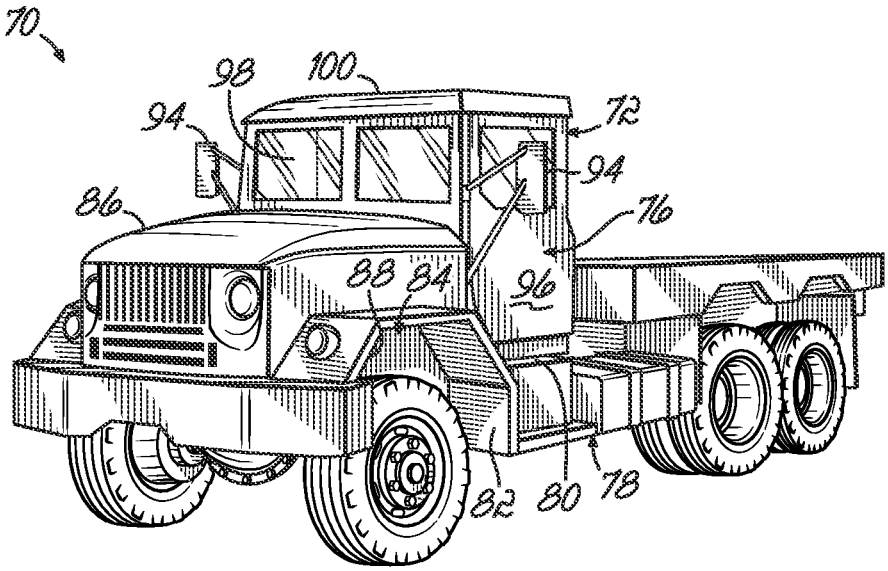
FIG. 3 is a perspective view showing an example of a vehicle to be fitted with protective armor.

As shown in FIGS. 1 and 2, the armored, composite shell 14 generally includes a top section 30, a rear section 32, and opposed side sections 34, 36. The opposed side sections 34, 36 can include respective doors 38, 40, each of which can be configured to receive a piece of bulletproof glass 42. The glass 42 functions as a window for the occupant compartment of a vehicle in an installed position. Similarly, a front section 44 can incorporate a bulletproof windshield 46 between the opposed side sections 34, 36 to further increase protection while maintaining visibility from within the armored shell 14. The windshield 46 may be comprised of first and second pieces 48, 50 of bulletproof glass as shown, or may be a unitary structure like many conventional windshields.

Figure 6:
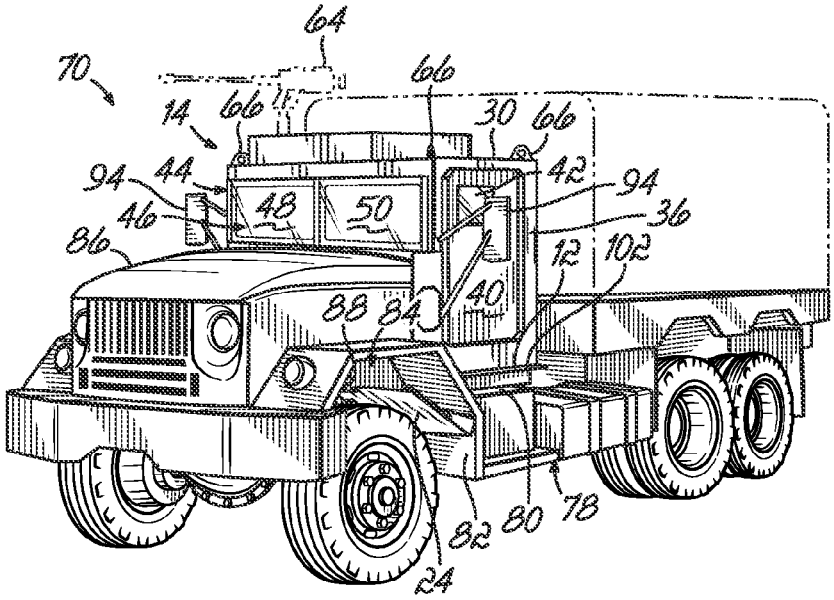

When the shell 14 is used in military or combat situations, the top section 30 may be provided with various additional features useful for protection. For example, the top section 30 may include an opening 56 covered by a sliding door 58. The door 58 can be configured to slide, for example, between opposed guides 60, 62 on the top section 30 to allow occupants protected by the armored shell 14 to access the space above the top section 30. Such a feature may be particularly useful when a weapon station or turret 64 (FIG. 6) is mounted to the top section 30, as known in the art. The top section 30 may also include one or more hoist retaining members 66 positioned thereon. The hoist retaining members 66 may be eyelets, flanges, or any other structure configured to cooperate with a hook or similar lifting element (not shown) so that the shell 14 may be raised and positioned using a hoist mechanism (not shown).

The sections 30, 32, 34, 36, 44 can be assembled together to define the armored shell 14 using any technique known in the art. For example, the sections 30, 32, 34, 36, 44 may simply be secured together by welding, fasteners, or a combination of the two techniques. The armored material used for both the shell 14 and the floor panel 12 may be any material capable of providing additional protection to the occupant compartment of a vehicle. For example, the armored material may be a steel or composite sheet capable of withstanding the impact associated with bullets and other projectiles.

With reference to FIGS. 3-6, a method of fitting a conventional vehicle 70 with the armored shell 14 will now be described. The vehicle 70 is a truck having a cab 72 with an internal occupant compartment 74 and outer body 76. The cab 72 is supported above a chassis or frame 78, which includes guide rails 80 and defines a portion 82 of a front wheel housing 84. A cowl or front body portion 86 is supported on the frame 78 and configured to define a remainder 88 of the front wheel housing 84. Although only one type of vehicle is shown in FIGS. 3-6, it will be appreciated that the method described below may be used to fit a wide variety of other vehicles with protective armor as well.

Figure 4:
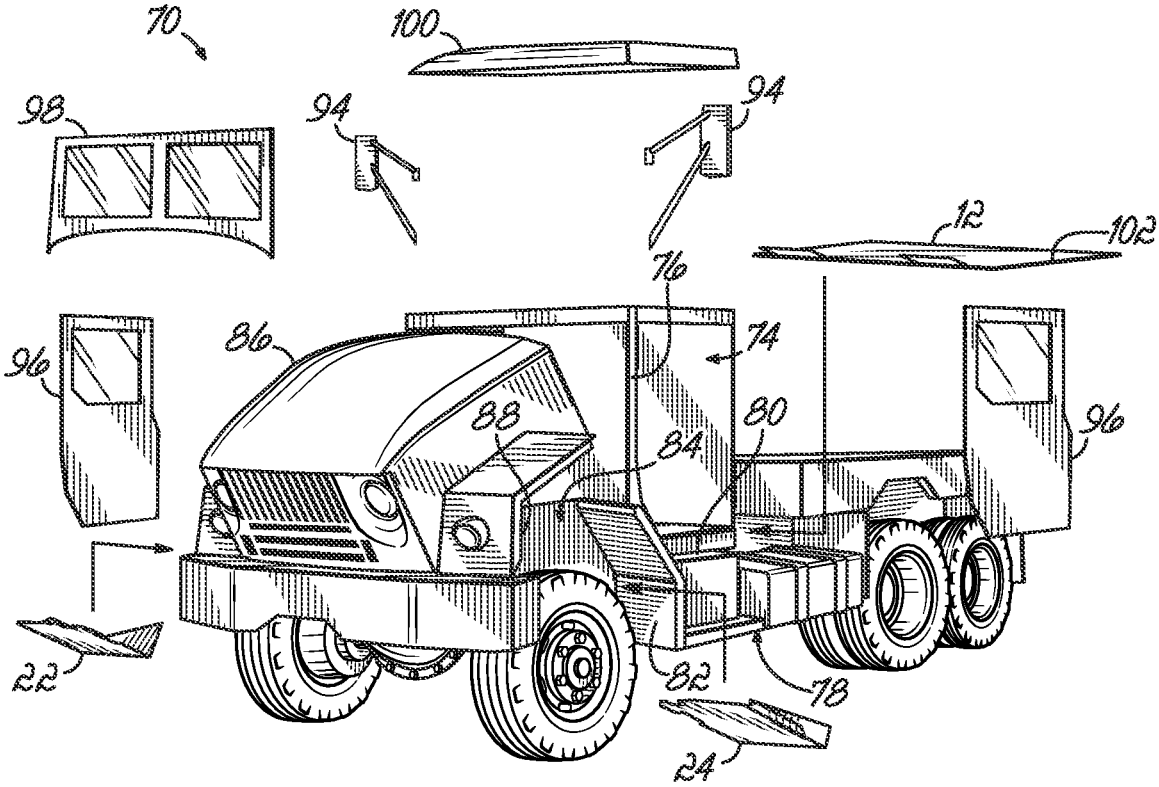
FIGS. 4-6 are perspective views showing components from the kit of FIG. 1 being installed on the vehicle of FIG. 3.

As shown in FIG. 4, the vehicle 70 is prepared to be fitted with protective armor by removing rear-view mirrors 94 mounted to the outer body 76 of cab 72. Side doors 96 and a windshield 98 are then removed from the cab 72 as well. When the top section 30 of armored shell 14 includes the opening 56 and sliding door 58, a top member 100 covering the outer body 76 may also be removed to expose the interior of the occupant compartment 74. This will allow an occupant to access the sliding door 58 when the armored shell 14 is in the installed position described below. Brackets (not shown) connecting the front body portion 86 to the outer body 76 of cab 72 are not usually designed to support armored material. Accordingly, these original brackets are removed and the front body portion 86 is then titled or adjusted as shown so that the components of the kit 10 may be installed to the vehicle 70. For some vehicles, it may not be necessary to adjust the front body portion 86 before installing the components of the kit 10.

Figure 5:
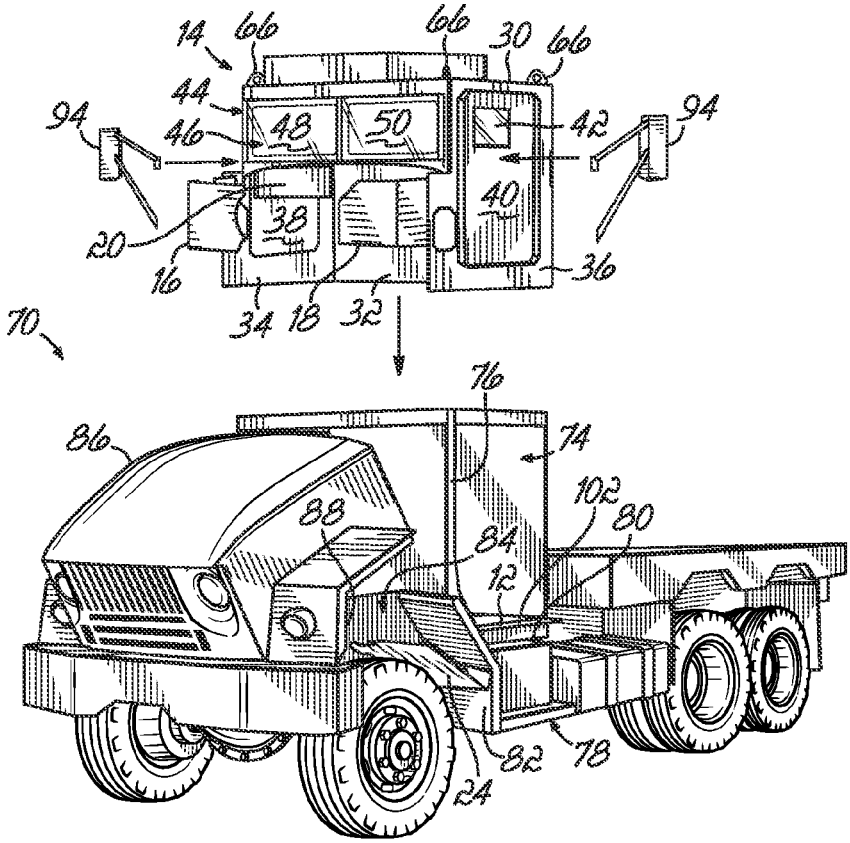

Now referring to FIGS. 4 and 5, the armored floor panel 12 is secured to the vehicle 70 below the cab 72. In other words, the armored floor panel 72 is slid under the occupant compartment 74; it can then be secured directly to the frame 78 or the guide rails 80. Because the armored floor panel 12 is designed with a larger area than a bottom of the cab 72, an outer portion 102 of the armored floor panel 12 extends beyond the outer body 76. The size of the armored floor panel 12 depends on the size of spacing desired between the outer body 76 and armored shell 14 in the installed position. This aspect will be described in greater detail below.

Once the armored floor panel 12 is installed, the armored shell 14 may be positioned over the outer body 76 of cab 72. The shape of the shell 14 may generally conform or correspond to the shape of the cab 72. In other words, the sections 30, 32, 34, 36, 44 of armored shell 14 are configured to surround the outer body 76 to protect occupants within the occupant compartment 74. The armored shell 14 may be positioned by a hoist mechanism (not shown) that lifts the shell 14 off the ground and transfers it onto the vehicle 70. More specifically, a hook or similar lifting element (not shown) engages the hoist retaining members 66 on top section 30. The hoist mechanism then raises the armored shell 14 from an initial position to a position directly over the occupant compartment 74. At this point, the hoist mechanism lowers the armored shell 14 onto the outer body 76 until the shell 14 rests upon the outer portion 102 of armored floor panel 12.

After the armored shell 14 has been properly positioned, the shell 14 is secured to the outer portion 102 of armored floor panel 12 using fasteners or other conventional coupling techniques. As mentioned above, the size of the armored floor panel 12 may depend upon the size of spacing desired between the outer body 76 and armored shell 14. For example, the armored floor panel 12 may extend approximately 2-3 inches beyond the outer body 76 to provide a space of similar size between the armored shell 14 and outer body 76. It will therefore be appreciated that the armored floor panel 12 may be designed with a wide range of sizes to accommodate the different sizes of the cab 72 and the desired spacing between components.

By installing the armored shell 14 to the armored floor panel 12, the frame 78 bears the additional weight from the protective armor. The frame 78 is much more capable of supporting this additional load than other areas of the vehicle 70. As such, securing the armored shell 14 to the floor panel 12 avoids many of the drawbacks associated with the outer body 76 or other body panels not being able to support armored materials. If desired, the armored shell 14 may be secured directly to the frame 78 without the use of an armored floor panel 12. Additionally, although the frame 78 is capable of supporting the armored shell 14, the suspension (not shown) of vehicle 70 may be reinforced if necessary.

The armored shell 14 may be further secured to the vehicle 70 by the first and second support brackets 16, 18. More specifically, the first and second support brackets 16, 18 can couple the armored shell to the front body portion 86. The support brackets 16, 18 may be secured to the front body portion 86 at the OEM (original equipment manufacturer) attachment points for the original brackets that were removed. At this point, the remaining components of the kit 10 may be installed to the vehicle 70. In particular, the lower blast panels 22, 24 may be secured within the front wheel housings 84 and the upper blast panel 20 may be secured proximate to one side of the occupant compartment 74. By the time all the components of the kit 10 have been installed, individuals within the occupant compartment 74 are protected from ballistics in all directions.

In addition to the steps described above, those skilled in the art will appreciate that several additional steps may be taken to further protect the vehicle 70 from explosions and projectiles. For example, the standard battery provided in the vehicle 70 may be removed and replaced with a more durable marine battery. The original seats may also be replaced with blast seats configured to absorb more shock. Advantageously, the blast seats may be secured to the OEM attachment points of the seats that were removed.

The armored shell 14 therefore provides a quick and easy way of fitting the vehicle 70 with protective armor. Simply positioning the shell 14 over the occupant compartment 74 offers a convenient alternative to the labor and time-intensive process of drilling holes into a vehicle body and installing individual armored panels. The method described above can be completed by as few as two people and in a relatively short amount of time. No complex electrical or fluid connection may be needed between the armored materials and the vehicle 70. Additionally, because only the cab 72 is armored as opposed to the whole vehicle 70, the amount of additional weight from the protective armor is minimized. This allows the vehicle 70 to attain relatively fast speeds and retain the ability to be easily transported by helicopters and airplanes.

When armored protection is no longer needed on the vehicle 70, the shell 14 may be removed by completing substantially the same steps as above but in the reverse order. In other words, the first and second support brackets 16, 18 may be unsecured from the front body portion 86 and armored shell 14. The armored shell 14 is then unsecured from the outer portion 102 of armored floor panel 12. After tilting or adjusting the front body portion 86 (if necessary), a hoist mechanism (not shown) may be used to lift the armored shell 14 off the vehicle 70. More specifically, one or more hook members or lifting elements (not shown) of the hoist mechanism engage the hoist retaining members 66 on the top section 30. The hoist mechanism then raises the shell 14 above the cab 72 and moves it away from the vehicle 70.

With the armored shell 14 now removed, the armored floor panel 12 may be unsecured from the frame 78 and removed from the vehicle 70 as well. Additionally, the original components of the vehicle 70 that were removed and replaced by more protective components can be reinstalled. For example, the original doors 96 of the vehicle 70 may be reinstalled to the outer body 76. The same can be said with respect to the original windshield 98, battery, seats, and other components discussed above.

To this end, the kit 10 and armoring method described above allows a retrofitted armored vehicle to be returned to its original condition. There are very few, if any, permanent modifications made to the outer body 76 of cab 72 during the installation and removal of the armored shell 14. In particular, the method describe above does not require drilling undesirable holes into the cab 72 or elsewhere. Additionally, the spacing provided between the shell 14 and cab 72 in the installed position prevents the outer body 76 from becoming scratched or damaged. The cab 72 therefore retains its original appearance and individuals riding in the occupant compartment 74 after the armored materials have been removed need not worry about the cab 72 having lost its structural integrity or effectiveness.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A method of fitting a vehicle with protective armor, the vehicle having a cab including an outer body and occupant compartment, the vehicle having a frame, the cab supported on the frame, the method comprising:

installing an armored floor panel to the frame of the vehicle below the occupant compartment;

positioning an armored shell over the outer body of the cab, the armored shell having at least a top section, a rear section, and opposed side sections configured to surround the cab so as to protect the occupant compartment;

the armored floor panel having an area that is larger than an area of a bottom of the cab thereby defining an outer peripheral portion of the armored floor panel that extends peripherally outwardly from the bottom of the cab; and securing the armored shell directly to the outer peripheral portion of the armored floor panel;

the armored floor panel and armored shell thereby being supported by the vehicle frame.

2. The method of claim 1, further comprising:

removing a windshield from the original cab, the armored shell further including a front section with a bulletproof windshield.

3. The method of claim 1, further comprising removing at least one door from the outer body of the cab, the armored shell having an armored door to define a portion of one of the opposed side sections; and installing a rear-view mirror to the armored door.

4. The method of claim 1, further comprising:

installing at least one bracket to a front portion of the vehicle, the at least one bracket being configured to support armored material;

wherein securing the armored shell further comprises securing the armored shell to the at least one bracket.

5. The method of claim 1, further comprising:

removing the armored shell from the cab of the vehicle; and removing the armored floor panel from the vehicle.

6. The method of claim 1, further comprising:

installing at least one armored panel to a wheel housing proximate the occupant compartment.

7. The method of claim 1, further comprising:

installing a weapon station on the top section of the armored shell.

8. The method of claim 1, wherein the armored shell is configured to be spaced from the cab when the armored shell is secured to the outer peripheral portion of the armored floor panel.

9. A kit for fitting a vehicle with protective armor, the vehicle having a cab including an outer body and occupant compartment, the vehicle having a frame, the cab supported on the frame, the kit comprising:

an armored floor panel configured to be installed to the frame of the vehicle below the occupant compartment; and an armored shell configured to be received over the outer body of the cab, the armored shell having at least a top section, a rear section, and opposed side sections configured to surround the cab so as to protect the occupant compartment;

the armored floor panel having an area that is larger than an area of a bottom of the cab thereby defining an outer peripheral portion of the armored floor panel that extends peripherally outwardly from the bottom of the cab;

the armored shell and the outer peripheral portion of the armored floor panel being directly secured to one another whereby the armored floor panel and armored shell are supported by the vehicle frame.

10. The kit of claim 9, wherein the top section, the rear section, and the opposed side sections of the armored shell are welded together.

11. The kit of claim 9, wherein the armored shell further includes a front section with a bulletproof windshield.

12. The kit of claim 9, further comprising:

at least one mounting bracket configured to be secured to the vehicle and adapted to support armored material.

13. A method of fitting a vehicle with protective armor, the vehicle having a cab including an outer body and occupant compartment, the vehicle having a frame, the cab supported on the frame, the method comprising:

positioning an armored shell over the outer body of the cab, the armored shell having at least a top section, a rear section, and opposed side sections configured to surround the cab so as to protect the occupant compartment;

installing an armored floor panel to the frame of the vehicle below the occupant compartment, the armored floor panel having an area that is larger than an area of a bottom of the cab thereby defining an outer peripheral portion of the armored floor panel that extends peripherally outwardly from the bottom of the cab, supporting the armored shell with the outer peripheral portion of the armored floor panel via direct securement of the armored shell to the armored floor panel, the armored floor panel and armored shell thereby being supported by the vehicle frame, operating the vehicle with the armored floor and shell installed, removing the armored floor and shell from the vehicle, and operating the vehicle after the armored floor and shell has been removed.

14. The method of claim 13 further comprising the step of configuring the armored shell such that when installed on the vehicle the armored shell is spaced away from the vehicle cab outer body.

* * * * *